US007258174B2

(12) United States Patent
Gjedrem

(10) Patent No.: US 7,258,174 B2
(45) Date of Patent: Aug. 21, 2007

(54) METHOD FOR PRESSURE- AND FLOW-PREVENTIVE FIXING OF PIPES IN A WELL

(75) Inventor: Torulf Gjedrem, Hafrsfjord (NO)

(73) Assignee: Sandamix AS (NO)

( * ) Notice: Subject to any disclaimer, the term of this patent is extended or adjusted under 35 U.S.C. 154(b) by 250 days.

(21) Appl. No.: 10/473,907

(22) PCT Filed: Sep. 7, 2001

(86) PCT No.: PCT/NO01/00367

§ 371 (c)(1),
(2), (4) Date: Oct. 29, 2004

(87) PCT Pub. No.: WO02/081861

PCT Pub. Date: Oct. 17, 2002

(65) Prior Publication Data

US 2005/0067162 A1 Mar. 31, 2005

(30) Foreign Application Priority Data

Apr. 3, 2001 (NO) ..... 2001 1678

(51) Int. Cl.
*E21B 33/14* (2006.01)

(52) U.S. Cl. ..... 175/22; 175/72; 166/292; 166/278

(58) Field of Classification Search ..... None
See application file for complete search history.

(56) References Cited

U.S. PATENT DOCUMENTS 3,866,681 A 2/1975 Shirley
4,417,625 A 11/1983 Henson et al.
5,058,676 A * 10/1991 Fitzpatrick et al. ..... 166/278
5,417,285 A 5/1995 Van Buskirk et al.
5,623,993 A 4/1997 Van Buskirk et al.
5,657,822 A 8/1997 James et al.
5,964,292 A 10/1999 Hewitt

FOREIGN PATENT DOCUMENTS

WO 96/37682 11/1996

* cited by examiner

*Primary Examiner*—Zakiya W. Bates
(74) *Attorney, Agent, or Firm*—Andrus, Sceales, Starke & Sawall, LLP

(57) ABSTRACT

A method for pressure- and flow-prevetive fixing of well pipes, preferably liners and casings (14, 54, 60, 66) in a well when drilling the well, wherein the method also may be used in a completed well in order to place a pressure- and flow-preventive barrier in an annulus (16) surrounded by at least one leaking well pipe. The method comprises the use of granular particles of unconsolidated matter which, by means of their particle sorting, are arranged with a suitably small permeability, and wherein the particles of unconsolidated matter thereafter are mixed with water and potential other additives to become a fluidised mixture of unconsolidated matter (22) subsequently being placed, preferably by pumping, as a pressure- and flow-preventive barrier of unconsolidated matter (38, 56, 62, 68) in the pertinent annulus (16). The barrier of unconsolidated matter (38, 56, 62, 68) is placed in the annulus (16) in such a way that inflowing fluids are brought into contact with, and are prevented from flowing by, the barrier of unconsolidated matter (38, 56, 62, 68) which, owing to the method, thus also is arranged with a suitably small permeability.

7 Claims, 3 Drawing Sheets

METHOD FOR PRESSURE- AND FLOW-PREVENTIVE FIXING OF PIPES IN A WELL

CROSS REFERENCE TO RELATED APPLICATION

The present application is the U.S. national stage application of International Application PCT/NO01/00367, filed Sep. 7, 2001, which international application was published on Oct. 17, 2002 as International Publication WO 02/081861. The International Application claims priority of Norwegian Patent Application 20011678, filed Apr. 3, 2001.

BACKGROUND OF THE INVENTION

1. Field of the Invention

The invention concerns a method for pressure- and flow-preventive fixing of pipes, for example casings and liners and possibly accompanying equipment, in a well when drilling the well. The method may also be employed in a well, for example a completed well, in order to place one or several pressure- and flow-preventive barriers in one or several cavities/voids of the well, preferably annuli, wherein at least one adjoining pipe of the cavity/void/annulus is leaking.

The method according to the invention has developed mainly as is a consequence of a large and increasing need existing among authorities and industry, primarily the petroleum industry, to improve and eventually replace prior art methods for fixing casings in a well, prior art methods being encumbered with a series of severe problems and disadvantages, and cement being the primary prior art means for fixing casings and liners in the well.

2. Prior Art

In connection with the drilling of a well, for example a petroleum well, and after having drilled a borehole down to a desired depth in the subsurface, it is customary to case the borehole with pipe(s). Usually the well consists of several such boreholes, or hole sections, that sectionally and consecutively run with diminishing hole diameter into the subsurface. It is therefore customary to provide the consecutive hole sections with casings of sectionally diminishing pipe diameters, wherein one casing size is placed within the preceding casing size etc. Each casing size usually runs up to, and is connected to, the wellhead of the well. So-called liners represent one exception to this which, on the other hand, do not run up to the wellhead of the well, and liners usually being employed to case one or several of the deepest hole sections of the well. Such liners are usually fixedly cemented within and to a lower part of a preceding casing in such a way that the upper part of the liner overlaps the lower part of the preceding casing only.

Most casings, including liners, are fixed by cementing to the relevant borehole wall and usually also to the preceding casing. In this context it is customary first to compute the amount of external annular volume of the pertinent casing to be filled with cement slurry, thereafter placing into said annulus/annuli a volume of cement slurry corresponding to at least that of the computed annular volume. With the exception of liners, cementing of most casing sizes is carried out by pumping said volume of cement slurry down through the pertinent casing, thereafter forcing the cement slurry out/up into the annulus between the pertinent casing and the hole wall of the well and, eventually, usually also up into at least a lower part of the annulus between the pertinent casing and the preceding casing. The cement slurry may be pumped in one or several stages, and into all or parts of the pertinent casing length, after which the cement slurry in principle shall harden into cement.

In the well, in order to avoid mixing, and thereby contaminating, the cement slurry with other liquids, usually drilling fluid, it is customary to place the cement slurry between two movable plugs, so-called wiper plugs, placed in the particular casing in order to facilitate the displacement of the cement slurry. The lower and foremost of said plugs is a leading plug, while the upper and hindmost plug is a trailing plug. Subsequently, and by means of pumping, the cement slurry and said plugs are displaced down through said casing. The leading plug is arranged with a through-going hole which is covered by a diaphragm (a membrane), while the trailing plug usually is a solid and is substantially stronger than the leading plug. By means of a fluid displacement column, usually a column of drilling fluid, placed on top of said trailing plug and arranged with necessary pumping equipment, the cement slurry and said plugs are subsequently pumped dorm through the casing until the leading plug is brought into contact with, and is arrested by, an associated seat or stopping device at the bottom of the casing. Subsequently the pump pressure is sufficiently increased for said diaphragm to rupture, after which the cement slurry is pumped through said hole in the leading plug and is further displaced out/up into said annulus/annuli. The pumping of cement slurry down through the casing continues until the trailing plug is brought into contact with, and is arrested by, the leading plug. The displacement of cement slurry out/up into said annulus/annuli is thereby completed, but a sufficiently large liquid pressure is maintained in the overlying fluid displacement column for the cement slurry to harden without introducing movements in the cement slurry during the curing process.

In connection with fixedly cementing a liner in a well, however, a cementing pipe must be connected between cementing equipment at the surface of the well, for example at/on a drilling rig, and a lower part of said liner. Usually, such a cementing pipe is comprised by a string consisting of connected drill pipes, the lower end part of the drill string being provided with an open and suitably adapted pipe, a so-called stinger, the stinger first being introduced into the well and being connected to a valve device located in the lower part of said liner. Analogous to the above-described method, cement slurry and associated leading- and trailing plugs may subsequently be pumped down through the cementing pipe and onwards to said valve device, after which the cement slurry is displaced out/up into the external annulus of the liner.

In the hardened condition, the cement constitutes a fixed mass which, among other things, shall function as a pressure- and flow-preventive barrier in said annulus/annuli of the well. In the event of potential fluid pressure differentials existing in the well, the cement shall prevent formation fluids from flowing between various formation layers and/or prevent formation fluids from flowing further upward in the well and possibly entirely to the surface. Also, the cement shall maintain the casings fixed to the borehole wall of the well and usually also within and to a preceding casing. For example, a surface casing of a well will largely support the weight of the other and smaller casing sizes of the well and also a wellhead or a blow-out preventer ("BOP"), and in this regard it is therefore necessary to establish a shear sustainable bond between the surface casing and the surrounding rocks, and in such a way that said loads may be transferred to the surrounding rocks. Thus, the shear sustainable and load transferring bond often consists of cement. Moreover, and upon commencing the drilling of the subsequent hole section, cement underlying and surrounding a casing shoe may contribute to stabilise a potentially fractured or unconsolidated rock in the hole wall of the well. This stabilisation of said hole wall contributes to prevent or reduce the falling of rock fragments from the hole wall of said well region and into the subsequent hole section while the drilling thereof is carried out.

In order to drill a well down to a drilling objective, for example an oil/gas reservoir, usually it is of absolute necessity to place in the annulus of the well, a pressure- and flow-preventive mass, for example cement and/or a pressure- and flow-preventive device, potentially a sealing arrangement, for example a mechanical packer. This particularly applies when drilling deep wells and/or when drilling wells down into subsurface layers wherein large fluid overpressures exist, simplistically denoted as overpressure. An overpressure exists if the pores of a subsurface rock layer are exposed to a fluid pressure exceeding the liquid pressure which otherwise would exist if the layer was exposed to a normal hydrostatic pressure gradient from the surface and down to the subsurface layer of interest.

Upon drilling down through the various subsurface layers, a drilling fluid with a specific gravity, and thereby a hydrostatic liquid pressure, which is arranged to counteract the fluid pressure in the rock pores being penetrated, is used in the borehole. This is done to prevent a potential and undesired inflow of formation fluids into the well. When, during drilling at ambient conditions, a normal hydrostatic gradient exists in the subsurface pore fluids, normally the pressure gradient which may be observed in water-filled upper layers of the subsurface, said hydrostatic pore fluid pressure may be counteracted by arranging the drilling fluid with a slightly larger specific gravity/pressure gradient.

The various subsurface formation layers may also exhibit different properties of strength, wherein the rock strength largely may be related to lithological composition, particle distribution, particle cementation and degree of compaction of the subject rock. Generally, the rock strength increases with increasing depth into the subsurface. This implies that rocks being penetrated by a well, may be exposed to, and may resist, a gradually increasing fluid pressure without fracturing being initiated in the rocks. A further increase of said fluid pressure will, however, result in fracturing of one or several of the penetrated rocks, this fracturing pressure commonly being denoted as the fracturing pressure of the subject rock(s), and the fracturing pressure commonly being recalculated, and expressed in terms of, an equivalent fracture gradient of the subject rock(s).

During drilling, upon approaching one or several formation layers with expected overpressures), the specific gravity/pressure gradient of the drilling fluid is increased to an extent necessary to withstand said overpressure(s). Thus, potentially overpressured formation fluids are prevented from flowing into the well upon drilling into, potentially after having drilled into, said layer(s). If said increase in the pressure gradient of the drilling fluid exceeds the fracture gradient of one or more of the penetrated rocks, the rocks(s) will be fractured and fractures develop in the rock(s). Then, drilling fluid may flow unobstructedly out (leak) from the well and into the fractures, thereby causing the height of the drilling fluid column, and thus the liquid pressure in the liquid column, to be lowered. By so doing, the formation pressure barrier brought about by the drilling fluid pressure exerted in the well is impaired, and this results in the establishment of an undesired, and potentially very dangerous, situation in the well. In order to prevent such fracturing it is often absolutely necessary to isolate the penetrated formation layers from pressures that may fracture the rocks contained therein. As mentioned, such a fracturing pressure may be exerted by the pressure, of the drilling fluid column, but the fracturing pressure may also be exerted by the overpressured formation fluids of other formation layers, usually deeper formation layers, which are being penetrated by the well during drilling.

Moreover, and pertaining to an open hole-section, it is the rock(s) of the shallowest part of the section, immediately underlying the casing shoe of the preceding casing, that generally, but not necessarily, is/are the weakest by strength, and thus being the one(s) which may first be fractured. After having started the drilling of a new hole section in a well, it is for this reason common practise to undertake a so-called formation strength test of the shallowest rocks in said hole section. Such a formation strength test is usually carried out immediately after having drilled the uppermost rocks along a 5-10 metre hole length of the new hole section. For example, the formation strength test may consist in supplying said rocks with drilling fluid under a gradually increasing liquid pressure, and increasing the liquid pressure until an incipient fracturing of, and an accompanying leakage of drilling fluid into, the rocks is observed, which determines the fracturing pressure/fracture gradient of the rocks. In the petroleum industry such a formation strength test is usually called a "leak-off test". In another commonly occurring formation strength test, a so-called formation integrity test, said rocks are also supplied with drilling fluid under a gradually increasing liquid pressure, limiting however the fluid pressure increase to a predefined maximum liquid pressure, and where this liquid pressure is considered to be the maximum required drilling fluid pressure to be applied for the new hole section to be drilled down to the desired drilling depths. This maximum liquid pressure is usually smaller than the fracturing pressure of said rocks, thus not fracturing the rocks during this formation strength test. Therefore, a formation integrity test is usually gentler on said rocks and the subsequent drilling operations than a fracturing test. Such formation strength tests therefore provide a good indication as to the magnitude of liquid pressure, or magnitude of the liquid pressure gradient, whereby the drilling fluid may be arranged during the drilling of a hole section in order to avoid fracturing of the accompanying rocks. Said maximum liquid pressure/liquid pressure gradient also limits the further drilling of a hole section to end at a depth at which the fluid pressure of a formation layer approaches said liquid pressure/liquid pressure gradient.

Cementing is also employed as a corrective method to prevent/reduce undesired inflow, and thereby also undesired pressure build-up, of a fluid in one or several regions of a well, including undesired fluid inflow through one or several leaking casings surrounding uncemented annuli of the well, the annulus/annuli possibly extending entirely up to the wellhead of the well. The method consists in injecting cement slurry, possibly with the addition of plasticizing agents, gelling agents, stabilisers or other additives, into a relatively short annular interval covering said inflow region (s), whereupon the cement slurry or agent hardens or sets in such a way that it forms a pressure- and flow-preventive barrier which, in principle, shall prevent/reduce such fluid inflows.

DISADVANTAGES OF THE PRIOR ART

Cementing jobs in a well are often encumbered with problems and disadvantages associated with the physical and chemical properties of the cement. At the start of a cementing job, the cement exists in a liquid state as a slurry. Later, and through a time-adapted curing process, the cement slurry is transformed to firm, or hardened, cement. It is therefore of paramount importance that the cement slurry is placed into the intended cavity/void, usually an annulus, of the well while the cement slurry is sufficiently fluidised to enable it to displace onwards into this cavity/void/annulus. Therefore, the placing of cement slurry into the well must be carried out before a significant thickening or hardening or the cement slurry has taken place. If, during the placing into the well, the cement slurry is thickened or hardens prematurely, or if the cement slurry is introduced into and is thickened/hardened in an incorrect region/interval of the well, the cement will easily cause more problems than what it solves. During the placing into the well, such a premature thickening/hardening of the cement slurry may develop if the slurry unintentionally is supplied with saline water, for example sea water or saline formation water. Upon placing the slurry against a permeable formation layer of a surrounding formation hole wall, a premature thickening/hardening of the cement slurry may also develop in the event that the slurry water phase is being filtered and flows into said permeable formation layer.

If the cement slurry is thickened/hardened earlier than planned, thickened/hardened cement unintentionally may be placed in pipes and/or equipment otherwise intended to be open throughout. For example, a premature thickening/hardening of the cement slurry in a cementing pipe and/or in a surrounding casing to be fixedly cemented, may result in the unintentional clogging of said pipes. Correspondingly, a cement slurry being pumped down through, possibly in or around, (a) leaking pipe(s), may result in the unintentional and firm cementing of pipe(s) and/or equipment not to be fixedly cemented, hence resulting in said pipe(s) and/or equipment not working as intended, and possibly in not being able to remove the pipe/equipment from the well if or when this should become necessary. For example, leakages in said cementation pipe and/or in the surrounding casing, may result in the cement slurry unintentionally being conducted onwards to the annulus between the outside of the cementing pipe and the surrounding casing, resulting in the cementing pipe unintentionally being fixed in said annulus upon thickening/hardening of the cement slurry. In the worst case, such unintentional occurrences may result in having to re-drill all or parts of the well. Said pipe leakages may also result in the cement slurry not displacing sufficiently far out/up into the relevant annulus to be fixedly cemented, which subsequently may result in the cement not exhibiting the desired pressure- and flow-preventive effect in the annulus.

In connection with such cementing jobs, channel-formed cavities/voids in the cement, so-called channelling in the cement, commonly develop, especially when cementing long pipe sections. Such channelling in the cement represents an undesired effect that may result from the cement slurry and an accompanying liquid front between the cement slurry and an overlying drilling fluid, are being exposed, among other factors, to an uneven laminar flow while the slurry is being displaced out/up into an annulus in the well. Such an uneven laminar flow often results in an insubstantially uniform and inefficient displacement of said liquid front in the annulus, drilling fluid channels thus being formed in the inflowing cement slurry as it flows out/up into the annulus, and resulting in said channels being maintained permanently in the annulus after hardening of the cement slurry. Said annulus may be an annulus between two casings and/or an annulus between one casing and a surrounding formation hole wall. Such channel-shaped cavities/voids in the cement often cause pressure- and fluid leakages.

Such pressure- and fluid leakages may also develop in connection with the curing process of the cement slurry. initially, during the curing process, cement nuclei are formed, increasing gradually into a sufficiently large number to form a continuous lattice structure of cement nuclei, the lattice structure being sufficiently strong to carry the weight of newly formed cement nuclei. At this stage of the curing process, when the load supporting lattice structure is established, and before consuming and chemically bonding the water phase of the cement slurry during the curing process, said water phase exists as an independent liquid in said lattice structure, the water phase at this stage of the curing process being exposed only to hydrostatic liquid pressures of its own and overlaying liquids. However, the hydrostatic liquid pressure of the water phase is substantially less than the hydrostatic liquid pressure of the original cement slurry. This reduction in hydrostatic liquid pressure may be sufficiently large for potential overpressured formation fluids of fluid-communicating formation layers to flow into the hardening slurry, causing subsequent pressure- and fluid leakages through it. The presence of such formation fluids in the hardening cement slurry may prevent a further chemical reaction between cement and water in such a way that the function of the cement as a pressure- and flow-preventive barrier in the well, is impaired or destroyed.

It is obvious, however, that such impairments of the cement in a well may result in the overlying rocks thus not being sufficiently protected against pressure conditions that may cause fracturing of the rocks. The fluid pressure from overpressured formation layers may thus propagate, via one or several annuli in the well, further upward in the well and, for example, cause an unintentional pressure build-up at the wellhead of the well. At worst, such pressure- and fluid leakages may lead to an uncontrolled outflow of overpressured formation fluids at the surface of the well, a so-called surface blow-out; or to overpressured formation fluids flowing, via the well, between different formation layers, a so-called underground blow-out.

Furthermore, hardened cement, in the manner used in a well, constitutes a stiff, brittle and substantially inflexible material possessing a relatively large shear strength. Advantageously, in some areas of utilisation, such material properties may be exploited. For example, cement may be used as a load transferring connection between a surface casing and its surrounding formation hole wall. As mentioned, in a borehole wall consisting of fractured or unconsolidated rocks, cement may be used as a shear-sustaining binding material binding together loose rocks and preventing the rocks from falling out from the hole wall and into the accompanying hole. During the drilling of a hole section, such a falling out of loose rock fragments may cause large technical drilling problems if, for example, such unfastened rock fragments firmly pack around a drill string and prevent or stop any further drilling.

In other areas of utilisation, however, such material properties may appear less advantageous. Some reservoirs consist, for example, of very porous sedimentary rocks, for example chalk or unconsolidated sand, such rocks often being soft and exhibiting very little material strength. In deeper layers of the subsurface, such porous rocks are usually overpressured, which overpressure is and, through geologic time, has been a necessary prerequisite in order to preserve the porosity of a rock during its course of compaction. In the process of recovering formation fluids from such a porous and weak reservoir rock, the formation pressure decreases gradually. Consequently, a corresponding and gradual compression (compaction) of the rock pores also will take place, resulting in accompanying vertical movements in the reservoir rock and in the overlaying rocks. However, well pipes, for example casings and/or liners, being placed in and throughout such compacting reservoir rocks are relatively. rigid and not of a physical state such that they, as for the rock pores, may be pressed together, thereby compensating for vertical movements in the reservoir. Consequently, relative movements take place between the well pipes and the surrounding rocks, and where the relative movements will tend to bend out/deflect, buckle/break and/or twist the pipes. Moreover, and due to the stiffness, shear strength and compressive strength of the cement, cementing such well pipes to the surrounding rocks will further tend to prevent this bending/deflection, buckling and/or twisting. Sufficiently large stress concentrations may thus be generated in the well pipes for one or several well pipes, in one or several places, to be torn to pieces or to be severely deformed. Such a destruction or deformation of one or several well pipes may result in a production well becoming completely or partially abandoned, or in having to drill a new production well, thus incurring large technical and economical disadvantages.

The method of injecting cement slurry, possibly plasticizers, gelling agents, stabilisers or other additives into a relatively short annulus interval covering one or several undesired inflow area(s) in a well, is also encumbered with channels being formed and subsequent accompanying pressure- and fluid leakages in the cement. Furthermore, production-related and relative pipe movements may also cause the cement to fracture or to unfasten from surrounding well pipes, and causing thus the cement to begin leaking. Usually, such a cementing procedure will therefore only provide a usable pressure- and flow seal for a short period of time, after which problems of pressure build-up and potential fluid leakages may reappear in the well.

THE OBJECTIVES OF THE INVENTION

One definite objective of this invention is to provide a new method for pressure- and flow-preventive fixing of pipes, for example casings and liners, and possibly accompanying equipment in a well.

Another definite objective of the invention is to be able to use the method in a completed well for the purpose of placing one or several pressure- and flow-preventive barriers in one or several annuli of which at least one pipe thereon is leaking.

The primary objective, however, is to be able to use the method, completely or partially, to replace the prior art functions of cement in a well, concurrently avoiding or reducing the above-mentioned problems and disadvantages associated with well cementing.

Achieving the Objectives

Instead of placing cement slurry in the relevant cavity/void of the well, usually an annulus, the objectives are achieved by placing along a sufficient length of said cavity/void/annulus, a fluidised mixture of unconsolidated matter. During the placing, the mixture of unconsolidated matter must be sufficiently fluidised for the mixture to displace onward to, and sufficiently far into, the cavity/void/annulus of interest. In most applications, the placing may be carried out in the simplest and most efficient way by pumping the mixture of unconsolidated matter, as for cement slurry, through a connecting pipe onward to and into said cavity/void/annulus of the well.

In this respect, pipes and equipment of the types known in the art for fixedly cementing pipes in a well, may be used. Largely, prior art methods for fixedly cementing such well pipes, may also be used for placing said mixture of unconsolidated matter into said cavity/void/annulus of the well. Furthermore, and for the purpose of providing the fluidised mixture of unconsolidated matter with rheological properties enabling the mixture to be placed in the well, knowledge in the field of rheology together with devices, methods and additives which, for example, are used in the preparation and handling of drilling fluids/well cement, may be employed.

In order for such a mixture of unconsolidated matter to work as a pressure- and flow-preventive barrier in the well, the mixture of unconsolidated matter, being a substitute for cement, must be arranged in such a way in the well that it, when the fluidised unconsolidated matter has set in its operational position in the cavity/void/annulus, exhibits sufficiently good pressure- and flow-preventive properties. In the method according to this invention, a mixture of unconsolidated matter comprised by naturally occurring and/or synthetically manufactured granular material, is therefore used in said barrier. In the operation position in said cavity/void/annulus, the granular particles are assembled in such a way that they exhibit a very small permeability towards a fluid flowing through the mixture of unconsolidated matter. Consequently, this method presupposes that the pressure- and flow-preventive barrier of unconsolidated matter is permeable, and that said fluid thereby leaks through the barrier of unconsolidated matter. If the barrier of unconsolidated matter is arranged with a sufficiently small permeability over a sufficiently long length interval in the well, and a fluid is flowing through the barrier of unconsolidated matter, the fluid in the barrier of unconsolidated matter, however, will be exposed to a large flow resistance (flowing pressure drop) and thereby move very slowly (very small flow velocity) through the barrier of unconsolidated matter, and in such a way that the corresponding through-put flow time of the fluid theoretically may extend to several tens of thousands of years or more. This course of flow is influenced by different parameters in accordance with Darcy's law which expresses a relation between several parameters and the flow velocity of a fluid when the fluid flows through a porous and permeable material; in which:

$$v=k(P_{in}-P_{out})/(\mu \cdot L);$$

wherein

- 'v'—flow velocity of the fluid (cm/sec),
- 'k'—permeability of the material (Darcy),
- '$P_{in}$'—upstream pressure potential of the fluid (atmospheres),
- '$P_{out}$'—downstream pressure potential of the fluid (atmospheres),
- '$(P_{in}-P_{out})$'—pressure loss through the material (atmospheres),
- 'μ'—viscosity of the fluid (centipoise)
- 'L'—length of permeable material (cm).

Considering that the fluid flow time through the barrier of unconsolidated matter theoretically is in the order of thousands of years, it is evident that the subsequent fluid leakage (amount of fluid leaking through the barrier) will be extremely small and, for practical purposes, negligible. On the other hand, by using a cement barrier in a well, large pressure- and fluid leakages through the cement barrier often appear and are observed. In the abovementioned perspective of time, however, such a cement barrier may constitute a substantially poorer, less enduring and insubstantially ductile/flexible barrier against pressure and flow than that of a barrier of unconsolidated matter.

The permeability 'k' of the mixture of unconsolidated matter and the extent or length 'L' of the barrier of unconsolidated matter in the well represent those parameters of Darcy's law which most readily may be influenced and controlled for the purpose of obtaining a sufficiently small fluid flow velocity 'v' through the barrier of unconsolidated matter. Also, and to a lesser degree, the flow velocity 'v' may be influenced and controlled by selecting a suitable downstream pressure potential '$P_{out}$' for the flowing fluid. In practice, '$P_{out}$' is comprised by the hydrostatic pressure being exerted on the barrier of unconsolidated matter by an overlaying/shallower liquid column, for example a water column, which hydrostatic pressure may be adapted, to some extent, by changing the specific gravity of the liquid column. The upstream pressure potential '$P_{in}$' of the fluid, however, usually is comprised by the formation pressure being exerted on the barrier of unconsolidated matter from an underlying/deeper reservoir layer, which pressure substantially may not be influenced/controlled, or may not be desired to be influenced/controlled, in consideration of said fluid flow velocity 'v' through the barrier of unconsolidated matter. On the other hand, there may exist a desire to influence/control said formation pressure '$P_{in}$' in consideration of the exploitation progress and degree of recovery of a reservoir, for example by implementing in the pertinent reservoir(s), actions of artificial stimulation, including water flooding.

According to Darcy's law, the permeability 'k' of the mixture of unconsolidated matter is proportional to the fluid flow velocity 'v' and, consequently, inversely proportional to the fluid through-put flow time, while the length 'L' of the barrier of unconsolidated matter is inversely proportional to the flow velocity 'v' and, consequently, proportional to the fluid through-put flow time. By so doing, the fluid flow velocity 'v' and also through-put flow time may be controlled by selecting a suitable permeability 'k' and/or barrier length 'L'. In practice, considering that the maximum barrier length 'L' is limited to the length of the pertinent cavity/void/annulus of a well, the largest scope of influence/control on the flow velocity 'v'/through-put flow time is gained by arranging the mixture of unconsolidated matter in such a way that it, in the operational position, exhibits a suitable permeability 'k'.

The physical and chemical conditions prevailing in the subsurface layers of the individual well may vary from well to well. Among other things, such physical and chemical conditions include reservoir depth, formation pressure(s) and temperature(s), type(s) of formation fluid(s) inclusive of its/their chemical compositions and physical properties, including properties or conditions influencing the viscosity of the fluid(s). Considering that the prevailing physical and chemical conditions may vary from well to well, the permeability that is considered to be suitable for the pertinent well, also may vary from well to well. Darcy's law shows, among other points, that the fluid viscosity 'μ' is inversely proportional to the fluid velocity 'v'. In one specific barrier of unconsolidated matter being arranged with a one specific permeability, a gas possessing a small viscosity, for example, will flow much faster through the barrier of unconsolidated matter than a heavy crude oil possessing a large viscosity is able to do in the same barrier. In the event of wanting the gas and the crude oil to flow with equal flow velocity through each their own barrier of unconsolidated matter of equal (flow through-put) length, the barrier of unconsolidated matter for the gas must therefore be arranged with a substantially smaller permeability than that of the barrier of unconsolidated matter for the crude oil.

A barrier of unconsolidated matter should be arranged such that it, in the operational position, exhibits a permeability in the order of preferably, but not necessarily, a few milliDarcy (mD) and down to a level of microdarcy (μD), for example 0.001 mD (=1 μD). In most wells, these are permeability values that will provide the desired pressure- and flow-preventive effect. Nevertheless, for reasons mentioned above, the specific permeability of the barrier should be evaluated and determined based on the prevailing conditions in the pertinent well.

The mixture of unconsolidated matter is arranged with the desired permeability by it being composed of, and in the operational position consisting thereof, mixed granular particles of at least one particle size and, preferably, of several particle sizes. Packed together, the permeability of the mixture of unconsolidated matter is determined by the geometric shape of a pore network comprised by the pores of the mixture of unconsolidated matter and their mutual pore connections. The degree of variation in particle sizes has a large impact on the tightness at which the unconsolidated matter particles may be packed, which largely influences how the pore network will appear, hence also what the permeability of the mixture of unconsolidated matter will be. Also, the general particle size of the mixture of unconsolidated matter are of great importance in determining how large the said pores and their mutual pore connections will be, which directly influences the permeability of the mixture of unconsolidated matter. Consequently, one of two methods may be used to affect the permeability of such a mixture of unconsolidated matter; either by the mixture of unconsolidated matter being comprised of different particle sizes, or by the mixture of unconsolidated matter being comprised of small particles of a relatively homogenous size.

The distribution of particle sizes in such a mixture of unconsolidated matter is often expressed by the concept of sorting. The concept of sorting is a qualitative measure of the degree of variation, or the range of variation, of different particle sizes in the mixture of unconsolidated matter. A poorly sorted mixture of unconsolidated matter may include a large spectrum of particle sizes, for example particles in the size ranges of gravel, sand, silt and clay. In comparison, a moderately sorted mixture of unconsolidated matter may include a small spectrum of particle sizes, for example medium sand and fine sand, while a very well sorted mass may include only one relatively homogenous particle size, for example coarse silt. In the packed condition, such a poorly sorted mixture of unconsolidated matter may exhibit a very small permeability. A very well sorted mixture of unconsolidated matter consisting of coarse silt may exhibit an equivalent small permeability, while a very well sorted mixture of unconsolidated matter consisting of very coarse sand may exhibit a very large permeability.

Such a specification of sorting, however, is imperfect for quantifying, or for specifying the quantities of, the different particle sizes comprising the mixture of unconsolidated matter. On the other hand, the distribution of particle sizes in the mixture of unconsolidated matter may better be described and quantified by means of, for example, statistical concepts, wherein the distribution of particle sizes in the mixture of unconsolidated matter may be described by means of a cumulative distribution function.

In practice, different particle sizes may be provided by, for example, sieving and grouping naturally occurring granular unconsolidated matter into several different particle size categories. Each such category is comprised of particles of a particular particle size range, the particle size range of each category differing from particle size ranges of possibly other categories. Alternatively, synthetically manufactured granular material made of particle sizes within the pertinent particle size categories may be used. Subsequently, certain amounts of particles of each of the pertinent particle size categories are assembled and mixed together, the mixture of unconsolidated matter thus being arranged with one particular distribution of particle sizes, hence one particular pore network shape of mixture of unconsolidated matter, which provides one particular permeability for the mixture of unconsolidated matter when placed in the operational position as a pressure- and flow-preventive barrier in the well.

Several scales exist specifying the different particle size categories, and the preferred scale may be related, largely, to particular trade disciplines. The so-called Udden-Wentworth particle size scale and the so-called Krumbein phi (ϕ) particle size scale are generally known and are used, for one thing, in geologic disciplines, for example in sedimentology. In the construction industry and in geotechnical environments, among other-matters, it is common, however, to use a scale referring to the mesh size (grate size) of a sieve device, for example the commonly used and so-called American Society of Testing and Materials (A.S.T.M.) Sieve Scale. The scale specifies particle size categories referring to so-called "mesh" sizes. For example, a 200 mesh size represents 0.074 mm large sieve openings in an accompanying screen-cloth or grate of the sieve device. Similar scales and/or concepts also exist which, to varying degrees, are used in different geographical regions and/or trade disciplines.

In the Udden-Wentworth scale, particles are grouped in particle size categories on the basis of average particle diameter specified in millimetres. Examples of such size categories are fine gravel/granules (2-4 mm), very coarse sand (1-2 mm), coarse sand (0.5-1 mm), medium sand (0.25-0.5 mm), fine sand (0.125-0.25 mm), very fine sand (0.0625-0.125 mm), four categories of silt (0.0039-0.0625 mm), and also clay particles (<0.0039 mm).

In the Krumbein phi (ϕ) scale, the particle sizes are converted to ϕ-values, in which:

$$\phi=\log_2 d;$$

wherein

'd'—average particle diameter (mm).

Expressed in Krumbein ϕ-values, the preceding Udden-Wentworth examples of particle size categories may be specified as fine gravel/granules (ϕ=−2 to −1), very coarse sand (ϕ=−1 to 0), coarse sand (ϕ=0 to +1), medium sand (ϕ=+1 to +2), fine sand (ϕ=+2 to +3), very fine sand (ϕ=+3 to +4), four categories of silt (ϕ=+4 to +8), and also clay particles (ϕ=+8 or more). Each particle size category being specified as integer ϕ-values, and not in fractions or decimal numerals, as in the Udden-Wentworth scale, such Krumbein ϕ-values are more easily treated statistically.

When using the Krumbein phi (ϕ) scale, the distribution of particle sizes in a mixture of unconsolidated matter (the sorting of the mixture of unconsolidated matter) is commonly specified as the range of variation (in ϕ-values) which includes an amount of particles comprising approximately ⅔ of all particles in the mixture of unconsolidated matter. Statistically, this range of variation constitutes two times the standard deviation of the unconsolidated matter particles, and the standard deviation is therefore a commonly accepted measure of the sorting of a sediment or a mixture of unconsolidated matter.

In the construction industry and in geo-technical environments, among other things, it is customary to quantify a particular distribution of particle sizes (sorting) of a mixture of unconsolidated matter by means of a so-called sieve curve. Specified in sieve- or mesh sizes, the sieve curve specifies the relative amounts, or the mass ratio, of the pertinent particle size categories which constitute, or is to constitute, the mixture of unconsolidated matter.

For example, the patent publication U.S. Pat. No. 5,417,285 describes the use of a short plug of particulate material in connection with a partition or obstruction member in a well, the partition/obstruction member typically consisting of a mechanical plug, for example an inflatable packer or a so-called bridge plug. Concurrently, and concerning the composition of the short particulate material plug, the publication describes seven different mixtures of particulate material and their specific and different particle compositions, each particle composition being expressed by means of "mesh" particle size categories and fractions by weight in percentages of the total weight of each mixture. At the same time, the permeability of each mixture of particulate material has been determined by testing and specified in the publication. Three of the said mixtures of particulate material showed especially a small permeability, and their particle compositions and permeabilities are of such a nature that they are considered suitable in a barrier of unconsolidated matter of the type comprised by this invention.

The particle composition and permeability of the three mixtures are stated in the following table summary:

| Particle size category (mesh sizes) | Test mixture - ref. test-number cited in the publication | | |
|---|---|---|---|
| | 7 | 8 | 9 |
| | Fraction by weight of the total weight of the mixture(%) | | |
| 20/40 mesh sand | 60 | 60 | 60 |
| 100 mesh sand | 20 | 15 | 20 |
| 200 mesh sand | 15 | 15 | 15 |
| Bentonite "gel" (clay fraction) | 5 | 10 | 5 |
| Permeability (mD) | 0.064 | 0.063 | 0.081 |

Said patent publication describes a 20/40 mesh sand as a conventional coarse sand, a 100 mesh sand as a conventional medium ("intermediate") sand and a 200 mesh sand as a conventional fine sand, the test mixtures 7-9 also containing a particle fraction of fines described as a gel of bentonite/clay particles. Chemically, the sand particles are described as consisting of preferably silica (silicon dioxide), mineralogically denoted as quartz. Also, this is a suitable choice in that quartz (silicon dioxide) is one of the most weathering resistant minerals to be found in nature, and quartz/silica (silicon dioxide) therefore ought to provide excellent time- and weathering resistance in a well.

Moreover, the proprietors of the present invention have carried out laboratory experiments involving a similar mixture of unconsolidated matter. Within a period of time of ca. 1.5 months, and by means of measurements, the permeability of the mixture of unconsolidated matter, among other things, was calculated as a function of the settling, or compaction, of the unconsolidated matter particles. Also, the experiments confirmed that it is possible, in practice, to produce a fluidised mixture of unconsolidated matter which is easy to pump. In the mixture of unconsolidated matter (predominantly silica/quartz), ca. 80 percent by weight of the mass consisted of sand size particles in the particle is size categories coarse sand (0.5-1 mm), medium sand (0.25-0.5 mm), fine sand (0.125-0.25 mm) and very fine-sand (0.0625-0.125 mm), while ca. 20 percent by weight of the mass consisted of silt size particles in the particle size range of 0.0039-0.0625 mm, half of which (ca. 10 percent by weight) in the size range of 0.005 mm (fine silt). The last-mentioned fine silt particles were added to the mixture of unconsolidated matter exclusively to act as a permeability-reducing filler of the pores in the mixture since this fraction of mixture fines only contains negligible amounts of clay particles. This differentiates this mixture of unconsolidated matter from the three mixtures specified in the preceding table, wherein relatively large fractions by weight of clay particles, so-called bentonite gel, are used in the mixtures, such suspended clay particles in the pores of the mixture acting as a binder between the particles.

Initially, a 1 metre length of mixture of unconsolidated matter was placed in the bottom of a vertically positioned plastic pipe, 6 metres long in total, after which the entire pipe was filled with fresh water. During the subsequent time period of ca. 1.5 months, regular measurements were taken whereupon the permeability of the mixture of unconsolidated matter was calculated for the time period, observing during the time period diminishing permeability values. At expiry of the time period, and after settling in the plastic pipe, the mixture could exhibit a permeability of 0.001 mD (=1 μD).

Furthermore, when being placed in the pipe, the mixture of unconsolidated matter was fluidised and contained ca. 83 percent by weight of unconsolidated matter particles and ca. 17 percent by weight of liquid, which consisted of ca. 11 percent by weight of water and ca. 6 percent by weight of a suitable plasticizer. The plasticizer was used in order to avoid uneven settling of the fine-grained and coarse-grained particle fractions of the fluidised mixture of unconsolidated matter, but also in order to maintain the largest possible fraction of unconsolidated matter, hence the smallest possible fraction of liquid, in the fluidised mixture of unconsolidated matter. Lignosulphonate represents one example of a common plasticizer/viscosity-regulating agent being used, for instance, in the petroleum industry, for example when preparing drilling fluids.

Moreover, these are merely examples of how such a mixture of unconsolidated matter may be composed, and of how the mixture of unconsolidated matter may be fluidised. Further specifications of compositions of mixtures of unconsolidated matter, and also specifications of specific substances and agents, devices and methods known in the art for fluidising the mixture, are considered to be of prior art technical nature provided the method according to this invention is brought forward to a person skilled in art.

After having assembled and mixed in specific quantities of the pertinent particle size categories, for example as specified in the table mentioned above, and in such a way that the mixture of unconsolidated matter thus has been arranged with a distribution of particle sizes which, in the operational position, is to provide the desired permeability, the mixture of unconsolidated matter is fluidised prior to placing it in the relevant cavity/void/annulus of the well, this fluidisation simplifying the placing of the mixture of unconsolidated matter in the well. For example, the fluidisation may be carried out by means of prior art devices and methods for stirring and mixing fluids and/or solids. In this fluidisation process, the mixture of unconsolidated matter is mixed together with a suitable carrier fluid to become a fluidised mixture of unconsolidated matter, the fluidised mixture of unconsolidated matter being arranged in such a way that it thereafter, and preferably, may be pumped, for example by means of powerful cementing pumps and -equipment of the kind typically being used during the cementing of well pipes.

Most simplistically, the carrier fluid may be comprised of water. On the other hand, plasticizers, gelling agents, stabilisers, weighting materials or other additives may be added in order to arrange the fluidised mixture of unconsolidated matter with appropriate physical and/or chemical properties, including rheological properties, to enable the mixture of unconsolidated matter to be placed and used as intended in the well. For example, the fluidised mixture of unconsolidated matter must be arranged with a viscosity enabling the pumping of the mixture through, for example, said cementing pumps/-equipment and connected pipes in the well so that the fluidised mixture of unconsolidated matter may be displaced further out/up into the pertinent cavity/void/annulus of the well. Also, and by example, the mixture may be arranged with suitable thixotropic properties. Furthermore, the carrier fluid should constitute a minimal weight fraction, suitable for the purpose, of the mixture of unconsolidated matter. Consequently, the fluidised mixture is comprised of a maximum weight fraction of unconsolidated matter particles forming the barrier of unconsolidated matter in the well, and this measure prevents or restricts a potential formation of surplus liquid originating from the carrier fluid. During pumping, possibly after the pumping and in connection with the settling of the mixture of unconsolidated matter in said cavity/void/annulus, such measures advantageously result in avoiding or reducing premature settling (segregation) of possible coarse-grained fractions and, hence, in segregating these from remaining suspended finer-grained particle fractions in the fluidised mixture of unconsolidated matter. A mixture of unconsolidated matter may thus be placed in the operational position in the well, a mixture which, after said settling, still is provided with the desired distribution and packing of particle sizes, thus also being provided with the desired permeability. Such a potential uneven settling of particle sizes in the mixture of unconsolidated matter, as a barrier of unconsolidated matter in the well, may result in it exhibiting an uneven permeability distribution along its longitudinal extension in the well, and in the barrier of unconsolidated matter not exhibiting the desired pressure- and flow-preventive effect in the well.

Moreover, and in connection with the placing of the unconsolidated matter, care must be exercised in ensuring that the fluidised mixture of unconsolidated matter is arranged with a specific gravity not exceeding the fracturing pressure/fracture gradient of the relevant hole section of the well. In this context, the fluidised and unconsolidated mixture possibly may be arranged with a specific gravity in the order of 2.1, which specific gravity does not differ from typical specific gravity values of a cement slurry.

Contrary to cement, such a barrier of unconsolidated matter may not harden in the cavity/void/annulus of the well. In the operational position, the barrier of unconsolidated matter therefore may exhibit plastic properties, inasmuch as the barrier of unconsolidated matter is flexible and ductile and, simultaneously, possibly may exhibit insignificant tensile- and shear strength. After having pressure- and flow-preventively fixed by means of the barrier of unconsolidated matter a specific casing size, these properties of such a barrier of unconsolidated matter must be considered in the event of commencing thereafter the drilling of a subsequent and deeper hole section. If said casing size, entirely from the casing shoe and up throughout the well, is fixed by means of such a ductile mixture of unconsolidated matter, and due to its insignificant tensile- and shear strength, the unconsolidated matter may easily fall down and into the subsequent hole section when being drilled. For instance, this problem may easily be avoided by placing in a length interval immediately underlying said barrier of unconsolidated matter, and in the same cavity/void/annulus, cement and/or another material possessing tensile- and shear strength, for example a mechanical annulus packer, and which prevents unconsolidated matter from falling down and into said hole section. In practice, and in the very same well pipes, this may be carried out by pumping down into the well, and also out/up into said cavity/void/annulus, a volume of cement slurry concurrent with, and immediately following, the fluidised mixture of unconsolidated matter. Afterwards, when the cement slurry is placed in its operational position and is hardening to form a cement barrier in the well, the mixture of unconsolidated matter will be prevented from falling down and into the subsequent hole section when being drilled. This is shown in the following embodiments of the invention. However, such a cement barrier need not be placed in the deepest casing/liner of the well, inasmuch as no subsequent hole section will be drilled into which the mixture of unconsolidated matter may fall down.

ADVANTAGES ACHIEVED BY THE INVENTION

Using one or several such barriers of unconsolidated matter in a well offers considerable advantages relative to the prior art, and relative especially to cementing of well pipes.

The placing of such a barrier of unconsolidated matter in a well does not involve, for example, a curing process that may create the above-described accompanying problems and disadvantages of cement, in which premature hardening/thickening of a cement slurry unintentionally may plug well pipes and -equipment, or possibly in unintentionally misplacing cement in the well. Hence, the potential problems that may develop in a cement slurry while, during the curing process, forming a continuous lattice structure of cement nuclei therein, are avoided, the formation of this lattice structure possibly resulting eventually in potential overpressured formation fluids originating from fluid-communicating formation layers flowing into the hardening slurry and inflicting subsequent pressure- and fluid leakages through the resulting cement barrier, hence weakening or destroying a further chemical reaction between water and cement, which results in the pressure- and flow preventive function of the cement in the well being weakened or destroyed. Such effects may not develop in a non-hardening barrier of unconsolidated matter because such a fluidised mixture of unconsolidated matter, during settling, will maintain its original liquid pressure/pressure gradient.

The absence of such a curing process, as well as said plastic properties of such a barrier of unconsolidated matter, also may result in the channelling in the fluidised mixture of unconsolidated matter not occurring, or occurring unsubstantially, when placed in the well. Due to the ductility of the mixture of unconsolidated matter, potential channels being formed in the mixture of unconsolidated matter may be pressed together and disappear, completely or partially, during the ensuing settling period of the unconsolidated matter particles. Potential fluids, for example drilling fluid, that have been trapped in such channels may thereby be displaced, completely or partially, out of the mixture of unconsolidated matter and not, as for a hardening cement slurry, inflict functional disturbance on the barrier in the well.

Also in posterity, awhile being placed as barrier of unconsolidated matter in a well, such a mixture of unconsolidated matter may retain its plastic properties and ductility. Any movements and displacements that, during time, may take place in the surrounding rocks of the well, for example earth quake movements or movements in compacting reservoir rocks, may thus, as for a cement barrier, inflict onto a barrier of unconsolidated matter and accompanying well pipes stresses and accompanying relative movements. As opposed to a cement barrier or a mechanical plug, the ductile barrier of unconsolidated matter, however, may be shaped according to, and adapt to, said relative movements without fractures and subsequent pressure- and fluid leakages being formed therein, and without substantially changing the small permeability of the barrier of unconsolidated matter. Such movements potentially may cause the permeability of the barrier of unconsolidated matter to be further lowered, inasmuch as such influencing forces, in addition to the Earth's force of gravity, may contribute to packing more closely the particles of unconsolidated matter, and thus causing said permeability to be lowered. Hence, the ductility and relative mobility of the barrier of unconsolidated matter cause well pipes to move in such a ductile mixture of unconsolidated matter, the well pipes being fixed by means of such a barrier of unconsolidated matter in the well wherein the well pipes are exposed to said stresses and relative movements. By so doing, such well pipes may be exposed to a substantially larger relative movement in the form of bending, buckling and/or torsion than that or a cement barrier or a mechanical plug before one or several well pipes are torn to pieces or become severely deformed.

Advantageously, such a fluidised mixture of unconsolidated matter also may be injected into uncemented cavities/voids/annuli of a well being exposed to undesired inflow of fluids through one or several surrounding and leaking casings/liners. The injection may be carried out, for example, through suitable perforations in a lower part of the casing/liner of the well, or via coiled tubing placed in an upper part of the pertinent annulus of the well. The fluidised mixture of unconsolidated matter is placed in a suitable position in, and in a sufficient well length of, the pertinent cavity/annulus, for example in the entire length of the cavity/void/annulus, thus preventing/reducing pressure- and fluid leakages through said cavity/void/annulus, and without using, for example, cement and/or mechanical packers in the cavity/void/annulus. By so doing, the lifetime of a leaking production tubing in a well may be extended in stead of having to re-complete or abandon the well.

Also, well pipes fixed by means of one or several such barriers of unconsolidated matter in a well provide for a significantly easier sidetracking or plugging, permanently or temporarily, of the well. This is due to the unconsolidated matter of the barrier readily being removed in posterity, for example by flushing or circulating out the unconsolidated matter by means of a suitable liquid. This substantially differs from the time-, equipment- and work consuming efforts being initiated in connection with the removal or drill-through of cement emplaced in connection with casing(s)/liner(s) of a well. This is illustrated further in the following embodiments of the invention.

Relative to the prior art, including well cementing, the above-mentioned advantages show that the method according to the present invention provides a substantially cheaper technical solution which, moreover, is considerably simpler, more flexible and durable with time with respect to preventing/reducing pressure- and fluid leakages in a well, primarily in connection with the fixing of casing(s)/liner(s) of the well. Also, the method may be used both in vertical, deviated and in horizontal wells.

BRIEF DESCRIPTION OF THE DRAWINGS

In the following part of the description, referring to FIGS. 1-5, three non-limiting embodiments of the method according to the invention will be shown, one specific reference numeral referring to the same detail in all figures is where this detail is indicated, wherein:

FIG. 1 shows a fluidised mixture of unconsolidated matter placed in said casing pending displacing of the mixture of unconsolidated matter out and up into an annulus surrounding the casing, while FIG. 2 shows the casing fixed in the hole section by means of the mixture of unconsolidated matter after it having been displaced out and up into said annulus, the mixture being placed as a pressure- and flow-preventive barrier of unconsolidated matter in the annulus;

FIG. 3 and FIG. 4 also show schematic vertical sections through a segment of the hole section shown in FIG. 2, the casing of the hole section being fixed in the well by means of the said barrier of unconsolidated matter in the surrounding annulus of the casing, and the figures show measures necessary in order to make a sidetrack of the well departing from said hole section, FIG. 3 showing perforation of the casing prior to a subsequent injection of cement slurry, while FIG. 4 shows a cut-through casing through which an introductory and new sidetrack hole section of the well is shown also.

DESCRIPTION OF EMBODIMENTS OF THE INVENTION

Knowledges, devices, appliances, equipment, agents, substances and/or methods known in the art not relating to the actual invention, but which nevertheless is/are, or may be, necessary prerequisites in order to practise the invention, will not be described in any detail in the following three embodiments. Among other things, this includes pumping devices/-equipment and accompanying pipes being placed suitably in the well when practicing the invention. Moreover, the figures only show details which are necessary in order to understand and practise the invention, and therefore the figures do not show, for example, a drilling arrangement and accompanying drilling equipment/well equipment etc.

Figure 1:
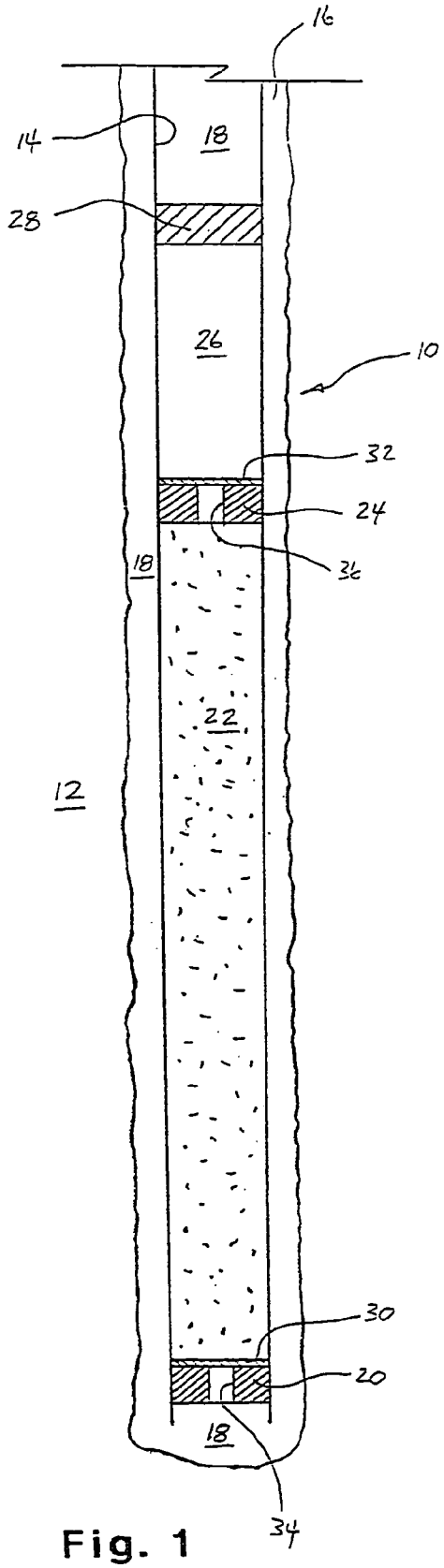
FIG. 1 and FIG. 2 show schematic vertical sections through a hole section of a well, in which hole section a casing is placed.
Figure 2:
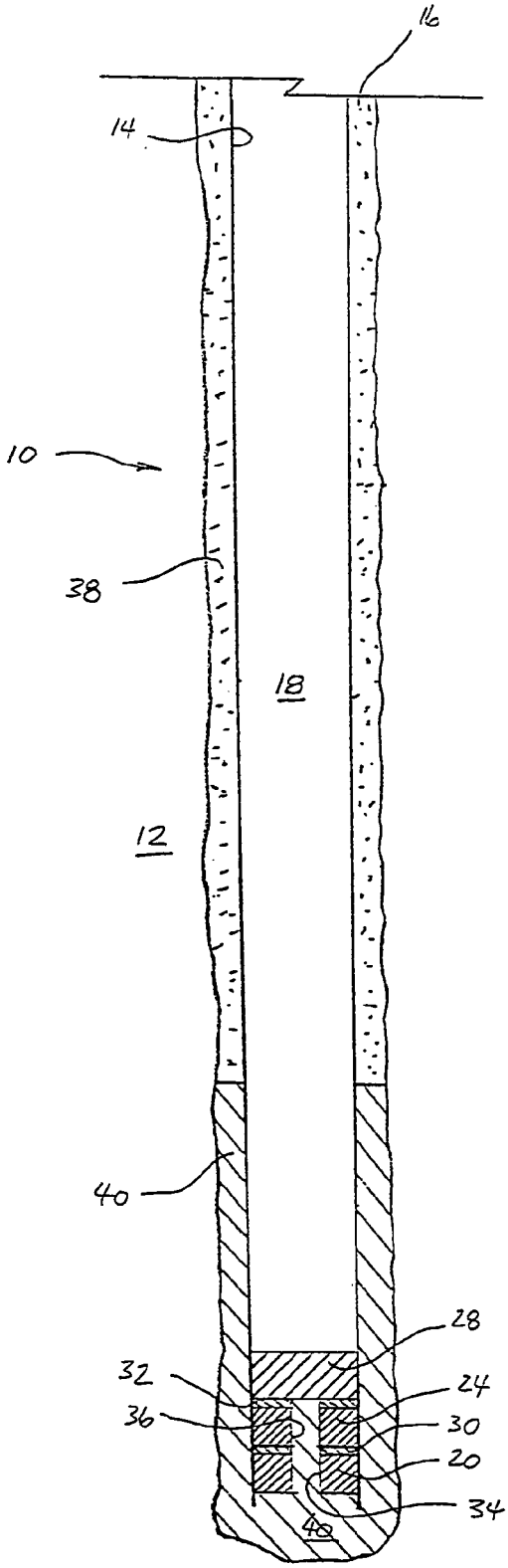

The first embodiment is represented by FIG. 1 and FIG. 2, FIG. 1 showing a lower part of a hole section 10 in a subsurface well, the hole section 10 penetrating an underground formation 12. A casing 14 is placed in the hole section 10, and between the casing 14 and the hole section 10 an annulus 16 exists being filled with drilling fluid 18, the drilling fluid 18 also filling a volume at the bottom of the casing 14. Immediately overlying this volume are placed, in consecutive order, a first leading plug 20, a predefined volume of a fluidised mixture of unconsolidated matter 22 according to the previous description, a second leading plug 24, a predefined volume of cement slurry 26 and a trailing plug 28, the overlaying volume of the casing 14 being filled with drilling fluid 18. All plugs 20, 24 and 28 are placed in a pressure-sealing manner against the casing 14. Furthermore, the leading plugs 20 and 24 are arranged with each their own diaphragm 30 and 32 which, in connection with the subsequent pumping and an accompanying displacement of the mixture of unconsolidated matter 22, cement slurry 26 and the plugs 20, 24 and 28 down through the casing 14 and out/up into the annulus 16, are arranged to rupture when the diaphragms 30 and 32 are exposed to a sufficiently large pump pressure. Furthermore, and associated with the diaphragms 30 and 32, each leading plug 20 and 24 is arranged with each their own through-going hole 34 and 36, through which the mixture of unconsolidated matter 22 and the cement slurry 26 may flow when the diaphragms 30 and 32 rupture due to said pump pressure. These conditions have been further described in the preceding description. However, the trailing plug 28 is massive and seats itself onto the second leading plug 24 at the end of the displacement, the second leading plug 24 being placed onto the first leading plug 20, and both leading plugs 20 and 24 being placed with ruptured diaphragms 30 and 32 in these positions. FIG. 2 shows the plugs 20, 24 and 28 placed in these positions, and this figure also shows said mixture of unconsolidated matter 22 placed as a pressure- and flow-preventive barrier of unconsolidated matter 38 in the annulus 16, the unconsolidated matter being arranged with a suitable permeability by means of the distribution of particles described above, is arranged with a suitably small permeability, the annulus in a bottom interval of the well also being filled with an underlying hardened cement in the form of a cement barrier 40.

Figure 3:
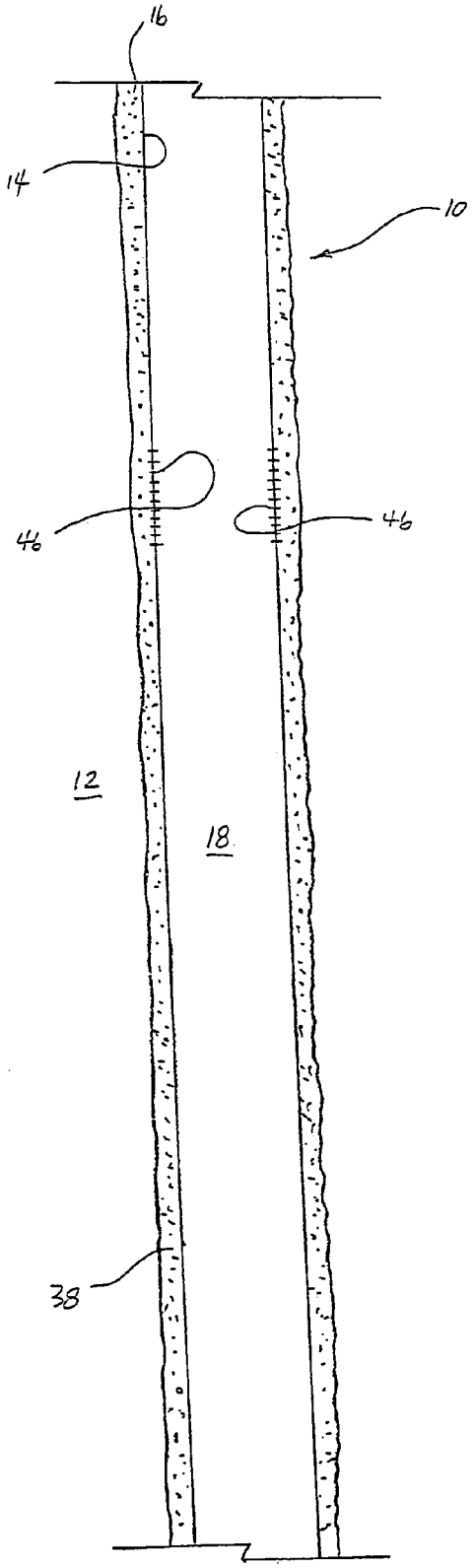
Figure 4:
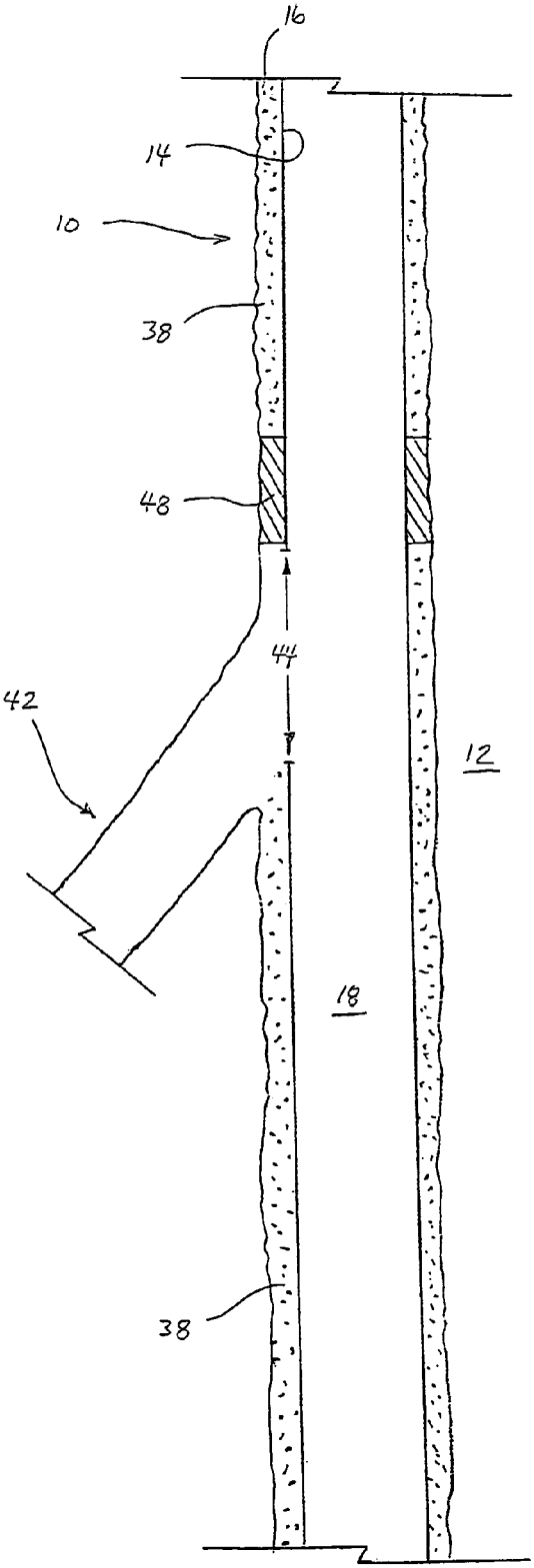

The second embodiment is represented by FIG. 3 and FIG. 4. The embodiment describes measures necessary for sidetracking in the underground formation 12, and by means of prior art drilling equipment, a hole section 42 extending out from the well hole section 10 in the event of the casing 14 thereof being fixed in the annulus 16 by means of pressure- and flow-preventive particles of unconsolidated matter, cf. the barrier of unconsolidated matter 38, FIG. 4 showing a segment of the sidetracked hole section 42. Moreover, this figure shows a hole 44 which, in order to enable sidetracking of the well, has been drilled through the casing 14 and the barrier of unconsolidated matter 38. The barrier of unconsolidated matter 38 surrounding the casing 14 exhibits insignificant tensile- and shear strength, and the drilling of a hole 44 through this barrier of unconsolidated matter 38 possibly may cause particles to unfasten and fall into the casing 14. By so doing, a section of length of the barrier or unconsolidated matter 38 being placed overlying the hole 44, may become destroyed, completely or partially, thus discontinuing, completely or partially, the function of the barrier of unconsolidated matter 38 as a pressure- and flow-preventive barrier. This is, however, a problem which may be solved through simple means. Prior to sidetracking, the casing 14 may be arranged with through-going perforations 46, cf. FIG. 3, in an area of the hole section 10 overlying the region in which the drilling of the hole 44 for the ensuing sidetrack is desired. Afterwards, a predefined volume of cement slurry is injected through the perforations 46 and into the barrier of unconsolidated matter 38. During the following hardening of the cement slurry, a cement plug 48 possessing substantial tensile- and shear strength is formed in the annulus 16. Thereafter, in a suitable position underlying the cement plug 48, the hole 44 through the casing 14 and the barrier of unconsolidated matter 38 may be drilled, inasmuch as the cement plug 48 prevents particles of unconsolidated matter from unfastening from an overlying part of the barrier of unconsolidated matter 38 and thereinafter falling down and into the casing 14. Then, the sidetracking of the hole section 42 may be carried out, the casing of the section 42 (casing not shown in the figures) possibly also being fixed by means of an equivalent barrier of unconsolidated matter. If the last-mentioned casing is fixed by means of an equivalent barrier of unconsolidated matter, in which this barrier of unconsolidated matter also is to be placed in an associated annulus section overlying the hole 44, it is important to ensure that the corresponding mixture of unconsolidated matter, during the placing thereof in the annulus of the section 42, does not flow out through the hole 44 and down into the underlying pipe volume of the casing 14. Possibly, this problem may be solved by said pipe volume, prior to sidetracking, either being filled by a corresponding mixture of unconsolidated matter (not shown in the figures), or by placing, in a position immediately underlying the hole 44, a mechanical packer plug (not shown in the figure), possibly also by filling a corresponding mixture of unconsolidated matter between the mechanical packer plug and the hole 44, and in the casing 14.

Figure 5:
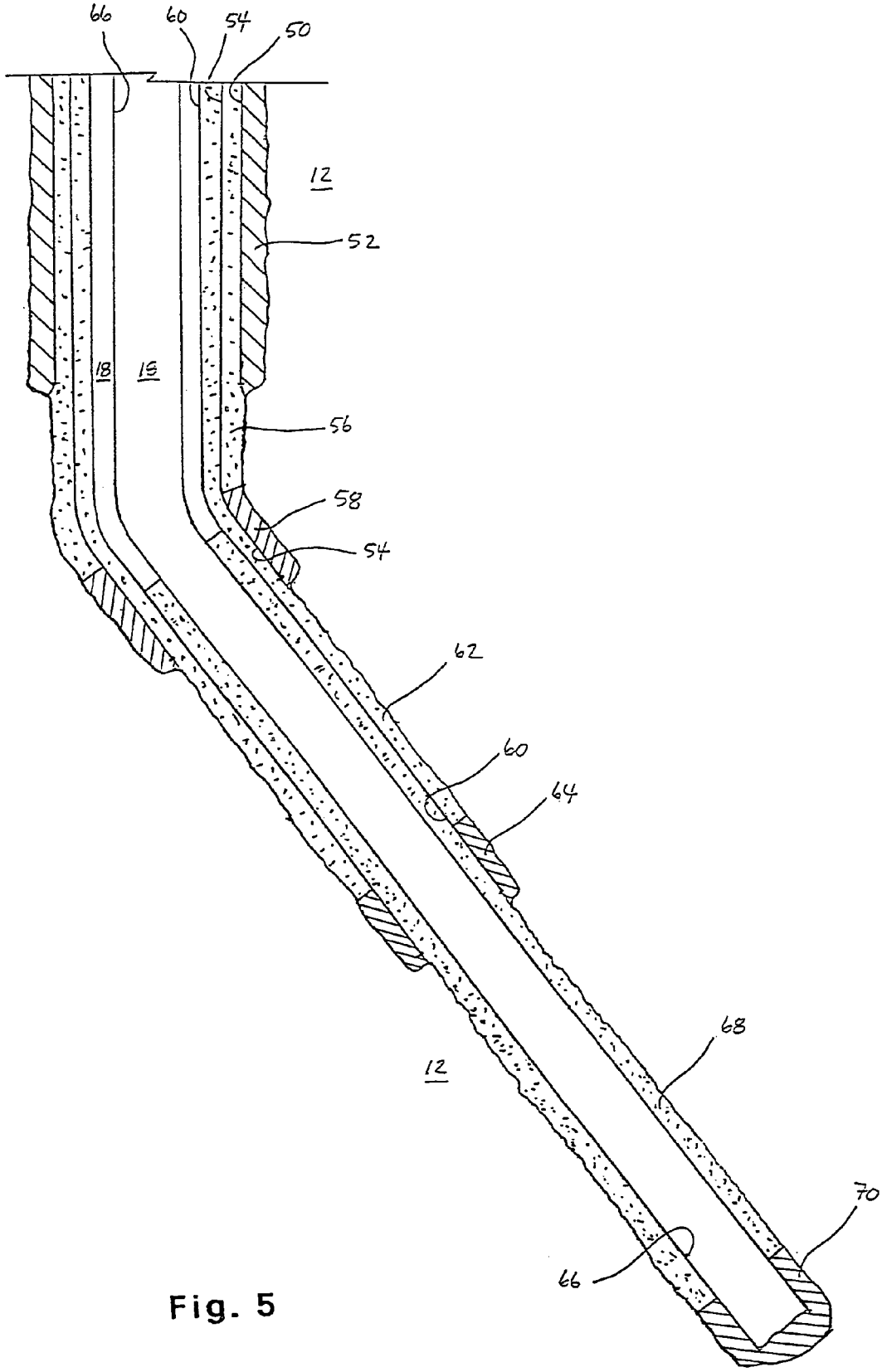
FIG. 5 shows a schematic vertical section through several consecutive hole sections of a well, each hole section being provided with each their own casing size, and all casing sizes being fixed in the well by means of a barrier of unconsolidated matter placed in the surrounding annulus of each casing size.

The third and last embodiment, represented by FIG. 5, shows a sidetracked well in the underground formation 12, the consecutive casing sizes of the well being pressure- and flow-preventively fixed by means of barriers of unconsolidated matter placed in respective and surrounding annuli thereof. In this embodiment, the surface casing 50 of the well is fixed in the underground formation 12 by means of cement 52. Meanwhile, the subsequent first intermediate casing 54 of the well is fixed by means of a barrier of unconsolidated matter 56 and a short underlying cement barrier 58, and the subsequent second intermediate casing 60 is fixed by means of a barrier of unconsolidated matter 62 and a short underlying cement barrier 64, the barriers of unconsolidated matter 56 and 62 extending upward to, or near, the wellhead of the well (not shown in the figure). The production casing 66 of the well is fixed by means of a barrier of unconsolidated matter 68 and a short underlying cement barrier 70, the barrier of unconsolidated matter 68 of this embodiment not extending upward to, or near, the wellhead of the well, but overlapping only a lower length interval of the preceding second intermediate casing 60. If the well is not drilled any deeper than that shown in FIG. 5, placing a cement barrier where the cement barrier 70 is shown in the figure is not required, strictly speaking, inasmuch as such a cement barrier 70 is placed in the well merely to prevent particles of unconsolidated matter from falling down and into a subsequent hole section (not shown in the figure).

The invention claimed is:

1. A method for pressure- and flow-preventive installation of at least one size of well pipe in a well during a drilling phase thereof, the method comprising the steps of:

mixing granular particles of unconsolidated matter composed of a low-permeability-generating particle sorting with at least water to form a non-hardening fluidized mixture;

placing said fluidized mixture in at least a section of an annulus positioned immediately external to said well pipe; and allowing the particulate unconsolidated matter of said fluidized mixture to set in said annulus so as to form a non-hardening and flexible pressure- and flow-preventive barrier for preventing fluids from flowing out of the well.

2. The method according to claim 1, wherein said fluidized mixture is placed between two casing sizes.

3. The method according to claim 1, wherein said fluidized mixture is placed between one casing size and a surrounding underground formation.

4. The method according to claim 1, wherein said particles of unconsolidated matter are also mixed with additives.

5. The method according to claim 4, wherein said additives include at least one of plasticizers, gelling agents and stabilizers.

6. The method according to claim 1, further comprising the steps of:

arranging said fluidized mixture to have properties that allow the mixture to be pumped; and pumping said fluidized mixture into said annulus.

7. The method according to claim 6, further comprising the step of:

pumping a cement slurry into said annulus immediately trailing said fluidized mixture, thereby allowing said cement slurry, when set, to form a cement barrier between said barrier of unconsolidated matter and a bottom of said annulus, whereby particles from said particulate barrier are prevented from falling down into a potential new hole section of the well.

* * * * *